US005592911A

United States Patent [19]

Komatsu

[11] Patent Number: 5,592,911

[45] Date of Patent: Jan. 14, 1997

[54] WATER-TIGHT CAP WITH VENT

[75] Inventor: Toshihiko Komatsu, Yokkaichi, Japan

[73] Assignee: Sumitomo Wiring Systems, Ltd., Japan

[21] Appl. No.: 518,077

[22] Filed: Aug. 22, 1995

[30] Foreign Application Priority Data

Oct. 24, 1994 [JP] Japan ..... 6-257933

[51] Int. Cl.[6] ..... H01T 13/06

[52] U.S. Cl. ..... 123/143 C

[58] Field of Search ..... 123/143 C, 169 PA, 123/169 PH; 439/125–128

[56] References Cited

U.S. PATENT DOCUMENTS 4,637,358 1/1987 Yano et al. ..... 123/169 PA
4,906,202 3/1990 Germ ..... 439/127
5,377,640 1/1995 Kobayashi ..... 123/143 C
5,462,023 10/1995 Furuya ..... 123/143 C

*Primary Examiner*—Tony M. Argenbright
*Attorney, Agent, or Firm*—Bierman and Muserlian

[57] ABSTRACT

A plug cap for an elongated bore has an upwardly open vent having an aperture. The aperture is provided with a water-tight flap, which is spaced apart from the uppermost section of the aperture and which is installed in a freely tiltable manner, so that the aperture of the vent can be closed by water pressure exerted on the plug cap. The cap is particularly intended for use in the ignition system of an internal combustion engine. In this context, when no water is sprayed, the heated air inside an elongated bore containing a spark plug is evacuated through the vent. When water is sprayed, as in the rain or a car wash, the aperture of the vent is closed by the water-tight flap under the water pressure, so that water is prevented from entering the elongated bore.

13 Claims, 4 Drawing Sheets

WATER-TIGHT CAP WITH VENT

This Application claims the priority of Japanese Application 6-257933, filed Oct. 24, 1994.

The present Invention is directed to a device for preventing entry of water into an opening while, at the same time, permitting venting thereof. It will be described with respect to an elongated bore containing a spark plug used in connection with an internal combustion engine, but it is understood that it is of broader application.

BACKGROUND OF THE INVENTION

An example of such a plug cap is described in JP-A-6/196246 (1994). The plug cap is traversed by an ignition cable and is freely mountable and removable with respect to an elongated bore which houses a spark plug. When fitted into the bore, the plug cap serves to prevent the ingress of water and, at the same time, holds an ignition pipe (also called "plug cap pipe") firmly in place.

When the engine is running, the air inside the elongated bore is heated and tends to expand, causing the plug cap to lift away from and float above the elongated bore. To avoid this, the plug cap is provided with one or more vent-holes at its upper face or side face to release the expanded air.

However, when the vent-holes extend upwards or sideways, they are vulnerable to water penetration and thus impair the sealing properties of the cap. Thus, when water is sprayed at pressure on such a plug cap, for instance when driving in the rain or washing the car, there is always a risk that water will penetrate the elongated spark plug bore. When this happens, electrical leakage may occur from the spark plug through the water. The plug can thereby fail to ignite properly, with adverse effects on the running of the engine.

SUMMARY OF THE INVENTION

It is thus an object of the present Invention to provide a plug cap traversed by an ignition cable and adapted to close the opening of the elongated bore which receives the spark plug, e.g. in a vehicle engine. The plug cap has vents for evacuating heated air from inside the bore without letting water enter, even when water at high pressure is sprayed around the plug cap, for instance when driving in the rain or washing the car.

To solve the above-mentioned problem, there is provided a plug cap for sealing the elongated bore which houses the spark plug in an internal combustion engine, the plug cap being traversed by an ignition cable and comprising at least one vent. It is a feature of the Invention that the aperture is provided with a water-tight flap connected thereto through a fixing element so that, in the normal state, the flap is kept open with respect to the aperture and, when the flap is impinged upon by moving water particles, it tilts over and closes the aperture with the fixing element acting as a fulcrum. In such a plug cap, the water-tight flap so configured as to be positioned substantially parallel to the aperture of the vent, thereby forming an air slit therebetween.

The fixing means is preferably a flexible hinge, more preferably one integral with the cap. In another desirable embodiment, the aperture slopes downwardly from the fixing element towards the opposite side, so that, when the flap tilts onto the aperture, it is parallel thereto and is tightly superposed thereon. Further, the vent is formed so as to open upwardly towards the outside through the plug cap. The plug cap can be made of any elastic material.

According to a preferred embodiment, the vent has an outer diameter of approximately 3 mm; the water-tight flap is approximately 0.5 to 2 mm thick; the thickness of the maximum air slit between the vent and the water-tight flap is approximately 0.3 to 1 mm; the hinge portion connecting the vent with the water-tight flap is between 0.3 and 0.5 mm thick; and the hinge portion is between 0.5 and 2.0 mm wide in the circumferential direction.

In a typical installation, the plug cap is fitted onto the elongated bore which houses the spark plug; an ignition cable is connected to the spark plug at one end and extends outside the elongated bore through a hole in the plug cap. There is also an ignition pipe, containing the ignition cable, which extends from the spark plug to the plug cap.

In the configuration of the plug cap as described above, the vent is provided, at a distance above the aperture, with a freely tiltable water-tight flap which can close off the vent aperture as soon as water pressure is exerted thereon. Thus, when no water is sprayed, the water-tight flap leaves the vent open so that the air inside the elongated bore can be evacuated. On the other hand, if high pressure water is sprayed on the plug cap, for example while driving in the rain or through a car wash, the water-tight flap closes off the vent under the pressure of the water, thereby preventing the water from entering the elongated bore.

An advantage of this configuration is that the water-tight flap may be fitted to the aperture of the vent through a flexible hinge integrally formed with the cap, thereby permitting manufacture by a simple procedure. Further, the uppermost edge of the aperture may be slanted downwardly so that the space between the flap and the aperture increases gradually from the fixing element towards the opposite side. Then, the water-tight flap is more tightly superposed on the vent aperture when the water exerts pressure thereon, thereby more efficiently preventing the water from entering the elongated bore.

BRIEF DESCRIPTION OF THE DRAWINGS

In the accompanying drawings, constituting a part hereof, and in which like reference characters indicate like parts.

FIG. 2(*b*) shows a schematic view of the dies by which the vent and the water-tight flap can be integrally formed;

FIG. 3(*b*) is a view, similar to that of FIG. 3(*a*), in which the water-tight flap is in its closed position;

FIG. 4(*b*) is a view similar to that of FIG. 4(*a*) in which the water-tight flap is in its closed position.

DETAILED DESCRIPTION OF THE INVENTION

Figure 1:
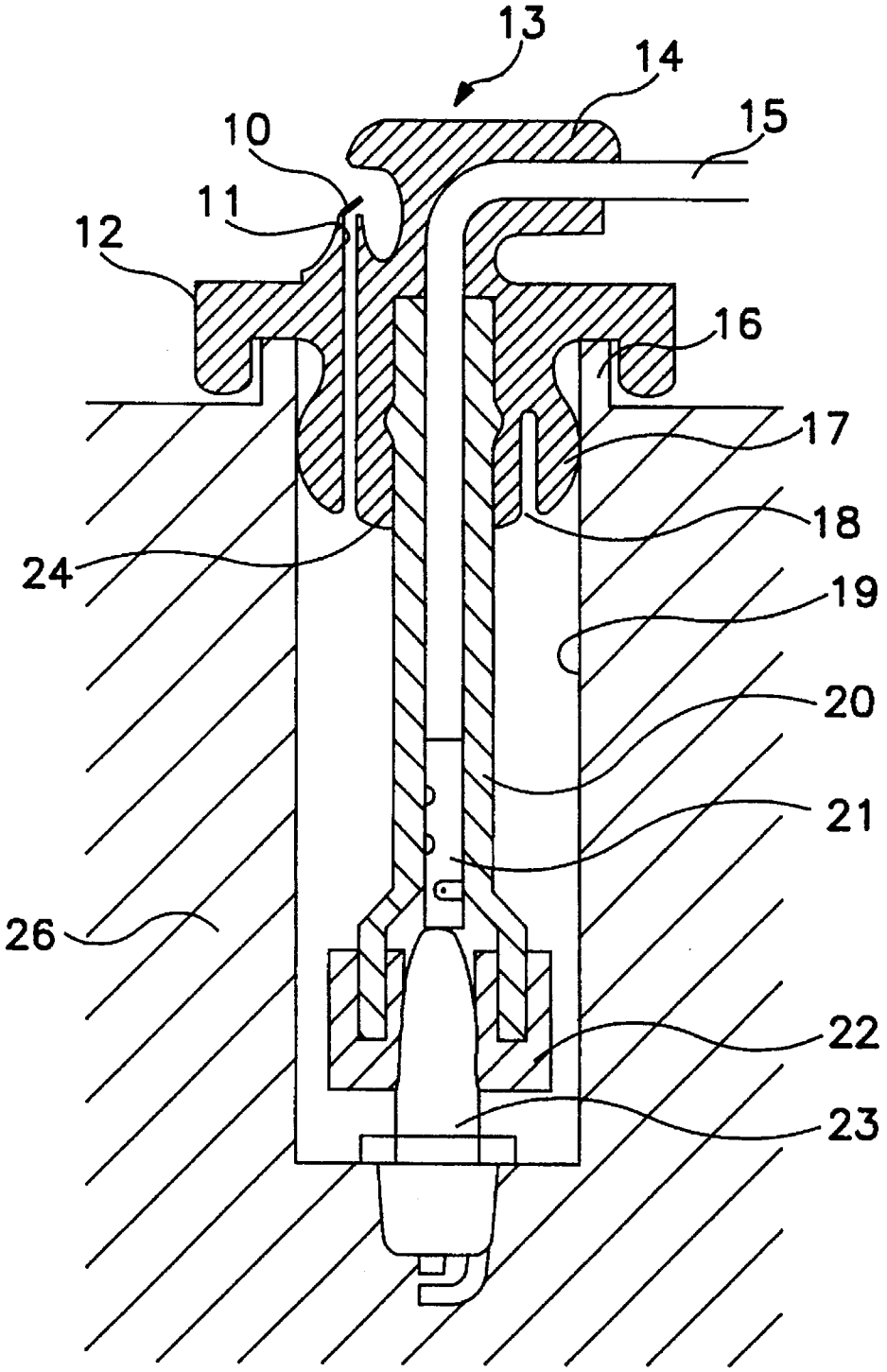
FIG. 1 is a sectional view of a plug cap provided with a vent and a water-tight flap according to the present Invention.

Referring to FIG. 1, plug cap 13 is made of an elastic material such as rubber for receiving ignition cable 15. Peripheral cover 12 engages external circular rim 16, which surrounds the opening of elongated bore 19. The base of plug cap 13 has a peripheral lip which contacts the wall of bore 19 near its opening to form seal 17. The lip is configured so as to be freely press-fitted inside the bore and removable therefrom. Plug cap 13 is provided with vent 11 which opens upwardly. The upper end of vent 11 has water-tight flap 10 which leaves vent 11 open in the normal state, but closes it when subjected to the impact of drops of water.

The lowermost face of seal 17 facing the base of bore 19 may optionally be provided with circumferential groove 18. The groove serves to reduce the insertion force necessary to fit plug cap 13 into the bore and so reduces the compressive strain experienced by the cap around seal 17 after insertion. The lowermost face of plug cap 13 is also provided with pipe-holding portion 24 configured to grip firmly the end of ignition pipe 20 closest to the bore opening.

Ignition pipe 20 receives cable 15 for spark plug 23, the cable passing through cable opening 14 and exiting therefrom. The other end of ignition pipe 20 is adapted to mount on spark plug 23 at the bottom of bore 19 via bushing 22. The plug end of cable 15 is equipped with electrical contract terminal 21 inside ignition pipe 20 and engages a corresponding contact of spark plug 23 to provide the required electrical connection.

Figure 2A:
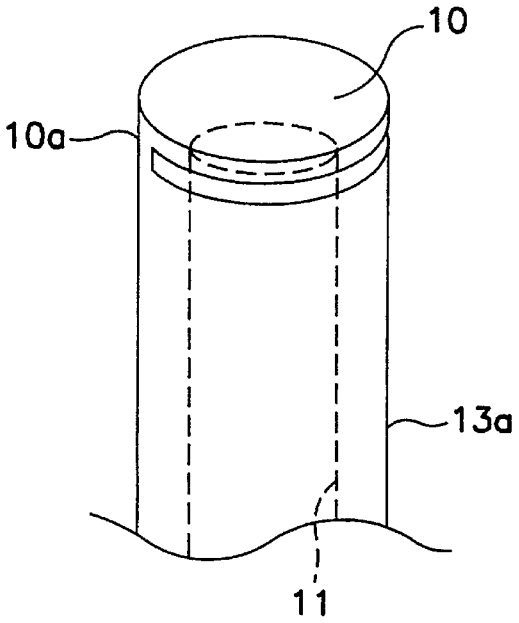
FIG. 2(*a*) is an enlarged perspective view of the water-tight flap in its normal position.
Figure 2B:
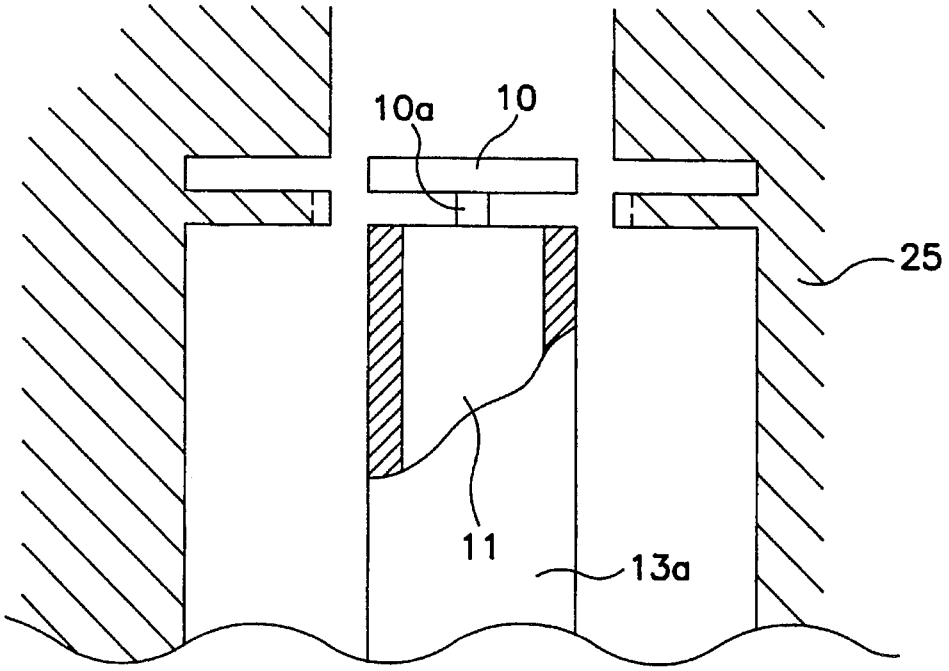

With reference to FIGS. 2(*a*) and 3(*a*), vent 11 has an opening at the top surface of plug cap 13. The opening is covered by a disc-shaped water-tight flap 10 disposed a short distance above the uppermost section of the opening. Water-tight flap 10 has hinge 10*a* which is integral with main body 13*a* of the plug cap, hinge 10*a* depending from the cap on, or adjacent to, its circumference. Flap 10 can be pivoted with hinge 10*a* serving as a fulcrum to open and close vent 11. Vent 11 and water-tight flap 10 may be formed jointly in a molding process by using dies 25 as shown in FIG. 2(*b*).

Figure 3A:
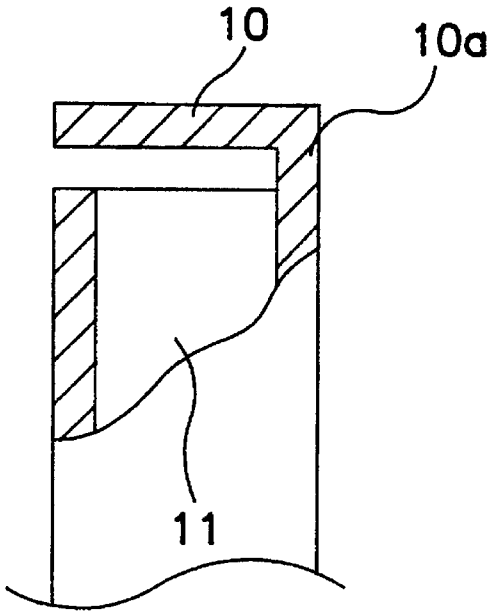
FIG. 3(*a*) is a sectional view of the vent and of the water-tight flap of FIG. 2(*a*)
Figure 3B:
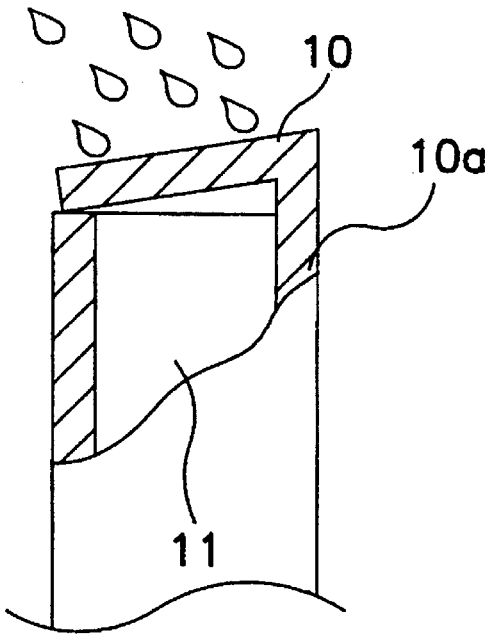

As shown in FIG. 3(*a*), when water-tight flap 10 is not sprayed with water (in its normal condition), flap 10 is located just above the aperture of vent 11. When the engine is running, the heated air contained inside bore 19 is evacuated therethrough. This ensures that there is no pressure build-up which otherwise could blow plug cap 13 out of bore 19.

On the other hand, when water is sprayed on plug cap 13 at some pressure (and thus also on the water-tight flap 10), it is pushed down to seal off vent 11 as shown in FIG. 3(*b*), so long as the pressure exerted by the water is greater than the excess pressure in the plug bore 19. Flap 10 can thus normally be expected to seal off vent 11 when driving in the rain, or through a car wash or the like, and thereby prevent the ingress of water into bore 19.

Figure 4A:
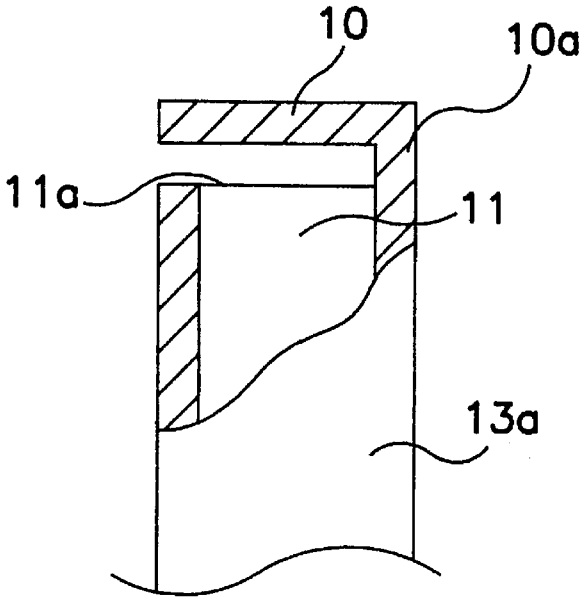
FIG. 4(*a*) is a sectional view, similar to that of FIG. 3(*a*), of another embodiment of the present Invention.
Figure 4B:
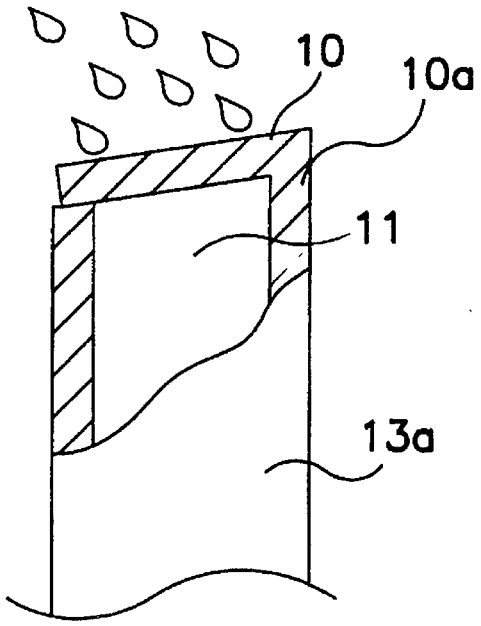

Vent 11 and water-tight flap 10 may be formed in the shape shown in FIG. 4(*a*). In this embodiment, uppermost section 11*a* of vent 11 is angled such that, in the normal condition, the aperture formed between vent 11 and water-tight flap 10 expands gradually from hinge portion 10*a* to the opposite side. In this construction, water-tight flap 10 is open, as shown in FIG. 4(*a*), when water is not being sprayed. Thus, heated air inside elongated bore 19 is evacuated via vent 11. On the other hand, when water is sprayed, water-tight flap 10 is pushed down by the pressure thereof, as shown in FIG. 4(*b*), so that it rests firmly on uppermost section 11*a*, thereby closing vent 11. Consequently, water penetration into the elongated spark plug bore 19 is more efficiently prevented.

Although the present Invention is described as having upwardly opening vents, another embodiment may comprise an angled and/or laterally open vent, with the same results being obtained.

What we claim is:

1. A plug cap for intermittently sealing a bore, said cap having an opening and comprising at least one vent having an aperture to permit evacuation of a gas from said bore, a flap adjacent said aperture, and a fixing element connecting said flap to said plug cap, said fixing element having an open position, wherein a portion of said flap is out of contact with said opening, and a closed position, wherein said flap contacts said opening and prevents entry of liquid therein, said flap being in said open position if no external force toward said opening is exerted thereon, said flap being in said closed position if a force toward said opening is exerted on said flap, said fixing element constituting a fulcrum about which said flap pivots between said open position and said closed position.

2. The plug cap of claim 1 wherein said bore is elongated and part of an internal combustion engine and houses a spark plug, there being an ignition cable attached to said spark plug.

3. The plug cap of claim 1 wherein said gas is air.

4. The plug cap of claim 1 wherein said fixing element is a hinge.

5. The plug cap of claim 4 wherein said hinge is located at or adjacent a periphery of said opening.

6. The plug cap of claim 4 wherein said hinge is integral with said plug cap.

7. The plug cap of claim 1 wherein said flap, when in said open position, is substantially parallel to and spaced apart from said opening, thereby forming said aperture.

8. The plug cap of claim 1 wherein an upper rim of said opening is slanted toward a base of said bore in a direction away from said fixing element, thereby said aperture widens in said direction when said flap is in said open position and seals against said upper rim when said flap is in said closed position.

9. The plug cap of claim 1 comprising a seal depending from said cap at or adjacent its periphery, said seal press-fitting into said bore and having a circumferential groove therein, whereby insertion of said seal into said bore is facilitated.

10. The plug cap of claim 8 wherein said fixing element is a flexible hinge.

11. The plug cap of claim 1 wherein said vent opens upwardly from said bore.

12. The plug cap of claim 2 wherein said elongated bore comprises a base in which a spark plug is housed, an ignition cable having one end electrically connected to said spark plug and its other end extending through a hole in said cap, an ignition pipe extending from said spark plug to said plug cap and containing said ignition cable.

13. The plug cap of claim 10 wherein said vent is substantially cylindrical and has an outer diameter of about 3 mm, said flap is about 0.5 to 2.0 mm thick, a maximum opening of said vent being about 0.3 to 1.0 mm when said flap is in said open position, said flexible hinge being 0.3 to 0.5 mm thick, and said hinge being 0.5 to 2.0 mm wide in a circumferential direction.

* * * * *